US010426682B2

(12) United States Patent
Tsusaka et al.

(10) Patent No.: US 10,426,682 B2
(45) Date of Patent: Oct. 1, 2019

(54) ROBOT, ROBOT CONTROL METHOD, METHOD, AND RECORDING MEDIUM

(71) Applicant: Panasonic Intellectual Property Management Co., Ltd., Osaka (JP)

(72) Inventors: Yuko Tsusaka, Osaka (JP); Yasunao Okazaki, Shiga (JP); Takahiro Shiwa, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 212 days.

(21) Appl. No.: 15/391,833

(22) Filed: Dec. 27, 2016

(65) Prior Publication Data

US 2017/0216119 A1 Aug. 3, 2017

(30) Foreign Application Priority Data

Jan. 29, 2016 (JP) ..... 2016-016680

(51) Int. Cl.
*A61G 7/10* (2006.01)

(52) U.S. Cl.
CPC ..... *A61G 7/1017* (2013.01); *A61G 7/1074* (2013.01); *A61G 7/1046* (2013.01); *A61G 7/1051* (2013.01)

(58) Field of Classification Search
CPC .. A61G 7/1017; A61G 7/1074; A61G 7/1046; A61G 7/1051; B25J 11/009
USPC ..... 700/245, 250, 264; 901/50
See application file for complete search history.

(56) References Cited

U.S. PATENT DOCUMENTS

2005/0209049 A1* 9/2005 Shields ..... A61H 1/001 482/8
2013/0219615 A1* 8/2013 Eklof ..... A61G 7/1017 5/83.1
2015/0005938 A1* 1/2015 Suzuki ..... A61G 7/1017 700/253
2015/0075575 A1* 3/2015 Karlovich ..... A63B 69/0064 135/66
2015/0297439 A1* 10/2015 Karlovich ..... A63B 22/02 280/650

(Continued)

FOREIGN PATENT DOCUMENTS

JP 2009-297463 12/2009
JP 2010-142562 7/2010

(Continued)

*Primary Examiner* — Bao Long T Nguyen
(74) *Attorney, Agent, or Firm* — Wenderoth, Lind & Ponack, L.L.P.

(57) ABSTRACT

A robot includes an arm mechanism that operates in accordance with a first motion pattern for supporting a user with a standing-up motion which starts in a sitting posture and finishes in a standing posture, a control unit that (i) acquires first information used to identify a predetermined position of the arm mechanism corresponding to a half-crouching posture of the user during a motion in accordance with the first motion pattern and (ii) detects whether the current position of the arm mechanism operating in accordance with the first motion pattern is included in a first range including the predetermined position identified by the first information, and a presentation unit that presents a first signal if the control unit detects that the position of the arm mechanism is included in the first range.

7 Claims, 13 Drawing Sheets

(56) References Cited

U.S. PATENT DOCUMENTS

| | | | | |
|---|---|---|---|---|
| 2015/0359694 | A1* | 12/2015 | Suzuki | A61G 7/1019 5/86.1 |
| 2016/0081594 | A1* | 3/2016 | Gaddipati | A61B 5/1113 600/595 |

FOREIGN PATENT DOCUMENTS

| | | |
|---|---|---|
| JP | 2013-039459 | 2/2013 |
| JP | 2013-039460 | 2/2013 |
| JP | 2013-158386 | 8/2013 |
| JP | 2014-223131 | 12/2014 |

* cited by examiner

FIG. 5

| MOTION ID | TIME (msec) | POSITION (m) |
|---|---|---|
| 1 | t0 | p0 |
| 1 | t1 | p1 |
| 1 | t2 | p2 |
| .. | .. | .. |
| 1 | tn−1 | pn−1 |
| 1 | tn | pn |
| ⋮ | ⋮ | ⋮ |

FIG. 6

| MOTION ID | HALF-CROUCHING POSITION TIME (msec) |
|---|---|
| mID1 | t11 |
| mID2 | t21 |
| ... | ... |

FIG. 7

| USER ID | MOTION ID | HALF-CROUCHING POSITION TIME (msec) |
|---|---|---|
| uID1 | mID1 | t11 |
| uID2 | mID2 | t21 |
| ... | ... | ... |

ROBOT, ROBOT CONTROL METHOD, METHOD, AND RECORDING MEDIUM

BACKGROUND

1. Technical Field

The present disclosure relates to a robot, a robot control method, a method, and a recording medium that support a care receiver with the motion.

2. Description of the Related Art

Standing-up motion support robots for supporting a care receiver with the standing-up motion have been developed (refer to, for example, Japanese Unexamined Patent Application Publication No. 2013-158386). The standing-up motion support robot described in Japanese Unexamined Patent Application Publication No. 2013-158386 includes a holding portion for holding the body of a care receiver, a main robot body for supporting the care receiver with the standing-up motion, and a controller for controlling the operation performed by an instruction unit in accordance with the amount of operation performed by an operator.

SUMMARY

However, further improvement is required for robots that support a care receiver with the motion to provide the information regarding the position thereof during the motion support.

In one general aspect, the techniques disclosed here feature a robot including a motion mechanism that operates in accordance with a first motion pattern for supporting a user with the standing-up motion which starts in a sitting posture and finishes in a standing posture, a control unit that (i) acquires first information used to identify a predetermined position of the motion mechanism corresponding to a half-crouching posture of the user during a motion in accordance with the first motion pattern and (ii) detects whether the current position of the motion mechanism operating in accordance with the first motion pattern is included in a first range including the predetermined position identified by the first information, and a presentation unit that presents a first signal if the control unit detects that the position of the motion mechanism is included in the first range.

According to the above-described aspect, further improvement of the robots can be provided.

It should be noted that general or specific embodiments may be implemented as a system, a method, an integrated circuit, a computer program, a computer-readable recording medium, or any selective combination thereof. Examples of the computer-readable medium include a nonvolatile recording medium, such as a compact disk-read only memory (CD-ROM).

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 5 illustrates an example of the information stored in a motion information database according to the exemplary embodiment;

FIG. 6 illustrates a first example of the information stored in a half-crouching position information database according to the exemplary embodiment;

FIG. 7 illustrates a second example of the information stored in the half-crouching position information database according to the exemplary embodiment;

DETAILED DESCRIPTION

Figure 1A:
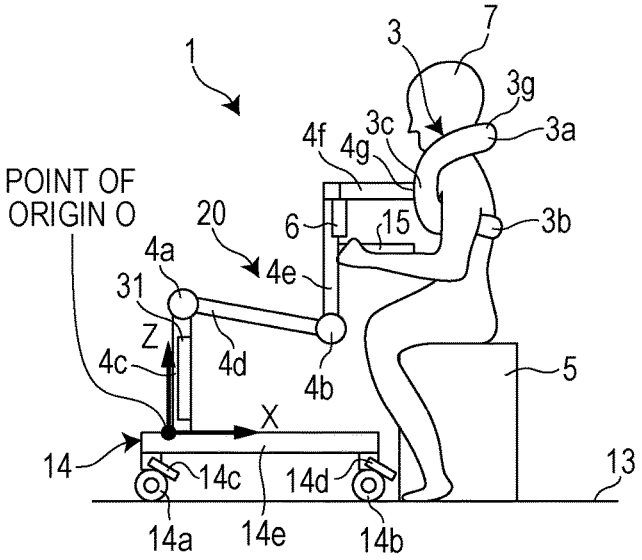
FIG. 1A is a schematic side view of the configuration of a robot according to an exemplary embodiment illustrated together with a care receiver.

Underlying Knowledge Forming Basis of the Present Disclosure

A key point of the aspect of the present disclosure is described first.

Japanese Unexamined Patent Application Publication No. 2013-158386 describes a standing-up motion support robot including a holding portion for holding the body of a care receiver, a main robot body for supporting the care receiver with the standing-up motion, and a controller for controlling the operation of an instruction unit in accordance with the amount of operation performed by an operator. In addition, Japanese Unexamined Patent Application Publication No. 2013-158386 describes a manual pulse generator as an example of the controller. The manual pulse generator includes a dial, an emergency stop button, a generator body, a turnover switch, and an auto mode enable switch (refer to Paragraph [0031] and FIG. 2 in Japanese Unexamined Patent Application Publication No. 2013-158386).

However, Japanese Unexamined Patent Application Publication No. 2013-158386 does not describe the case in which a care receiver is in a posture between a sitting posture and a standing posture by halting the robot during an operation for supporting the care receiver with the standing-up motion (i.e., the care receiver is in a half-crouching posture). That is, Japanese Unexamined Patent Application Publication No. 2013-158386 does not describe even the case where a care receiver is in a half-crouching posture and, thus, does not describe any indication of the half-crouching position presented to the care receiver. Furthermore, Japanese Unexamined Patent Application Publication No. 2013-158386 does not describe a process to store, in a storage unit, the position of a predetermined portion of the robot when the robot was halted before as the position of a predetermined portion of the body of the care receiver in an optimum half-crouching posture (hereinafter, the position is referred to as a "half-crouching position") and present, to the care receiver, the indication of the stored half-crouching position.

Accordingly, the present inventors have conceived the idea of the following aspects of the present disclosure.

According to an aspect of the present disclosure, a robot includes a motion mechanism that operates in accordance with a first motion pattern for supporting a user with a standing-up motion which starts in a sitting posture and finishes in a standing posture, a control unit that (i) acquires first information used to identify a predetermined position of the motion mechanism corresponding to a half-crouching posture of the user during a motion in accordance with the first motion pattern and (ii) detects whether the current position of the motion mechanism operating in accordance with the first motion pattern is included in a first range including the predetermined position identified by the first information, and a presentation unit that presents a first signal if the control unit detects that the position of the motion mechanism is included in the first range.

When a robot is used to support a care receiver with the standing-up motion which is from a sitting posture to a standing posture of a care receiver, the robot may be instructed to halt its operation during the standing-up motion. For example, when a care receiver stands up from a toilet, the robot needs to temporarily halt the support of the standing-up motion to allow the care receiver to put on their underwear and trousers while in the half-crouching position.

However, since the body height or the hunched position varies from care receiver to care receiver, the height (or the position) at which the care receiver in the half-crouching posture puts on, for example, underwear varies from care receiver to care receiver. Accordingly, if only one stop position of the robot while supporting with the standing-up motion is selected for all care receivers, the stop position may not be appropriate for some of the care receivers.

According to the present aspect, the robot acquires a predetermined position of the motion mechanism (e.g., a position when the care receiver is in a half-crouching posture). If the control unit detects that the position of the motion mechanism is included in a range including the acquired predetermined position (a first range), the robot presents a first signal to the care receiver. In this manner, the robot can present the position when the care receiver is in an appropriate half-crouching posture.

In addition, according to the present aspect, the motion mechanism may be capable of halting the operation on the basis of manipulation performed on the motion mechanism, and the robot may further include a storage unit that stores position identification information used to identify a position at which the motion mechanism is stationary for a predetermined period of time or longer during the motion in accordance with the first motion pattern. The control unit may acquire the position identification information stored in the storage unit as the first information and perform the detection using the acquired first information.

If a period of time for which the motion mechanism is stationary while supporting the care receiver with a standing-up motion is longer than a predetermined period of time, it can be considered that the care receiver is putting on, for example, an underwear for the period of time. In addition, the position of the robot at which the robot halts can be considered as a half-crouching position appropriate for the care receiver in a half-crouching posture.

According to the present aspect, the position of the motion mechanism at which the motion mechanism is stationary for a predetermined period of time or longer during the motion in accordance with the first motion pattern is defined as a first position. In this manner, a half-crouching position appropriate for the care receiver can be set without the care receiver inputting the position.

In addition, according to the above-described aspect, for example, the storage unit may store the position identification information in association with each of a plurality of care receivers. The control unit may receive user identification information associated with one of the plurality of care receivers before the motion in accordance with the first motion pattern is performed, acquire the position identification information associated with the care receiver indicated by the received user identification information as the first information, and perform the detection by using the acquired first information.

The appropriate half-crouching position varies from care receiver to care receiver. Accordingly, by receiving the identification information associated with one of the care receivers before the robot starts supporting with the standing-up motion, the robot can present, to the care receiver, a half-crouching position appropriate for the care receiver.

In addition, according to the above-described aspect, for example, the motion mechanism may operate in accordance with a second motion pattern for supporting a care receiver with a sitting-down motion which starts in a standing position and finishes in a sitting position. The control unit may further (i) acquire second information used to identify a predetermined position of the motion mechanism corresponding to the half-crouching position of the user during the operation in accordance with the second motion pattern and (ii) detect whether the current position of the motion mechanism operating in accordance with the second motion pattern is included in a second range including the predetermined position identified by the second information. The presentation unit may further present a second signal if the control unit detects that the position of the motion mechanism is included in the second range.

As in the standing-up motion, when the robot is used to support the care receiver with the sitting-down motion which is from the standing posture to the sitting posture, the robot may be instructed to halt during the sitting-down motion. For example, when a care receiver sits down on a toilet, the robot needs to temporarily halt during the sitting-down motion to allow the care receiver to take off their underwear and trousers while in the half-crouching posture.

However, as in the standing-up motion, since the body height and/or the hunched position varies from care receiver to care receiver, the position when a care receiver in the half-crouching posture, which is a position in the sitting-down motion, takes off, for example, underwear varies from care receiver to care receiver. Accordingly, only one stop position of the robot while supporting with the sitting-down motion is selected for all care receivers, the stop position may not be appropriate for some of the care receivers.

According to the present aspect, the control unit receives a second position of the motion mechanism at which the robot halts during the operation in accordance with the second motion pattern for supporting with the sitting-down motion and presents a second signal to the care receiver if the control unit detects that the second position of the motion mechanism is included in the second range. In this manner, the robot can present a half-crouching position appropriate for the care receiver.

In addition, according to the above-described aspect, for example, the position identified by the first information may differ from the position identified by the second information.

The appropriate half-crouching position in the standing-up motion may differ from the appropriate half-crouching position in the sitting-down motion. For example, in general, in a motion range which is between the positions of the predetermined portion of the body of a care receiver in a standing posture and in a sitting posture, the appropriate half-crouching position for the care receiver in the sitting-down motion is closer to the position of the predetermined portion of the care receiver in the standing posture than in the standing-up motion. This is because to halt the body at a position close to the position of the predetermined portion of the body in the sitting posture during the sitting-down motion, the care receiver needs such a muscle strength that halts the body forced to move in a sitting direction and, thus, a physical burden on the care receiver is excessive.

According to the present aspect, the first position, which is the half-crouching position in the standing-up motion, differs from the second position, which is the half-crouching position in the sitting-down motion. Thus, a more appropriate half-crouching position can be presented to the care receiver in each of the standing-up motion and the sitting-down motion.

According to another aspect of the present disclosure, a robot includes a motion mechanism that operates in accordance with a first motion pattern for supporting a user with a standing-up motion which starts in a sitting posture and finishes in a standing posture and a control unit that (i) acquires first information used to identify a predetermined position of the motion mechanism during the motion in accordance with the first motion pattern and (ii) reduces a speed of the operation performed by the motion mechanism if the control unit detects that the current position of the motion mechanism operating in accordance with the first motion pattern is included in a first range including the predetermined position identified by the first information.

When the robot supports a care receiver with a standing-up motion which starts in a standing posture and finishes in a sitting posture, the robot may be instructed to halt during the standing-up motion. For example, when a care receiver stands up from a toilet, the robot needs to temporarily halt during the standing-up motion to allow the care receiver to put on their underwear and trousers in the half-crouching posture, which is a posture in the standing-up motion.

However, since the body height or the hunched position varies from care receiver to care receiver, the height (or the position) at which the care receiver in the half-crouching posture puts on, for example, underwear varies from care receiver to care receiver. Accordingly, if only one stop position of the robot while supporting with the standing-up motion is selected for all care receivers, the stop position may not be appropriate for some of the care receivers.

According to the present aspect, the robot acquires a first position of the motion mechanism when the motion mechanism halts during a motion in accordance with a first motion pattern for supporting with a standing-up motion. If the robot detects that the current position of the motion mechanism is included in the first range, the robot reduces the speed of the motion mechanism operating in accordance with the first motion pattern. For example, if the operating speed is set to a sufficiently low speed, the operating speed is sufficiently reduced when the robot approaches the position at which the robot was halted before by the care receiver during a standing-up motion. In this manner, the robot can let the care receiver to know the half-crouching position appropriate for the care receiver.

In addition, according to the above-described aspect, for example, the motion mechanism may be capable of halting the above-described operation thereof. The robot may further include a storage unit that stores position identification information used to identify a position at which the motion mechanism is stationary for a predetermined period of time or longer during the motion in accordance with the first motion pattern. The control unit may acquire the position identification information stored in the storage unit as the first information and perform the detection by using the acquired first information.

In addition, according to the above-described aspect, for example, the storage unit may store the position identification information in association with each of a plurality of users, and the control unit may receive user identification information associated with one of the plurality of users before the motion in accordance with the first motion pattern is performed, acquire the position identification information associated with the user indicated by the received user identification information as the first information, and perform the detection by using the acquired first information.

In addition, according to the above-described aspect, for example, the motion mechanism may further operate in accordance with a second motion pattern for supporting a care receiver with a sitting-down motion which starts in a standing posture and finishes in a sitting posture. The control unit may further (i) acquire second information used to identify a predetermined position of the motion mechanism corresponding to the half-crouching position for the care receiver during the operation in accordance with the second motion pattern and (ii) reduce a speed of the operation performed by the motion mechanism if the control unit detects that the current position of the motion mechanism operating in accordance with the second motion pattern is included in a second range including the predetermined position identified by the second information.

In addition, according to the above-described aspect, for example, the position identified by the first information may differ from the position identified by the second information.

These configurations provide the advantages that are the same as those described above.

According to still another aspect of the present disclosure, a method for controlling a robot including a motion mechanism is provided. The motion mechanism operates in accordance with a first motion pattern for supporting a user with a standing-up motion which starts in a sitting posture and finishes in a standing posture. The method includes acquiring first information used to identify a predetermined position of the motion mechanism during a motion in accordance with the first motion pattern, detecting whether the current position of the motion mechanism operating in accordance with the first motion pattern is included in a first range including the predetermined position identified by the first information, and presenting a first signal if it is detected that the position of the motion mechanism is included in the first range.

According to yet still another aspect of the present disclosure, a program is provided. The program causes a computer to perform the above-described method.

According to yet still another aspect of the present disclosure, a method for controlling a robot including a motion mechanism is provided. The motion mechanism operates in accordance with a first motion pattern for supporting a care receiver with a standing-up motion which starts in a sitting posture and finishes in a standing posture. The method includes acquiring first information used to identify a predetermined position of the motion mechanism during a motion in accordance with the first motion pattern and reducing a speed of the operation performed by the motion mechanism if it is detected that the current position of the motion mechanism operating in accordance with the first motion pattern is included in a first range including the predetermined position identified by the first information.

According to yet still another aspect of the present disclosure, a program is provided. The program causes a computer to perform the above-described control method.

It should be noted that general or specific embodiments may be implemented as a system, a method, an integrated circuit, a computer program, a computer-readable recording medium, such as a CD-ROM, or any selective combination thereof.

Exemplary embodiments are described in detail below with reference to the accompanying drawings.

Note that each of the embodiments described below is a general or specific example of the present disclosure. A value, a shape, a material, a constituent element, the positions and the connection form of the constituent elements, steps, and the sequence of steps described in the embodiments are only examples and shall not be construed as limiting the scope of the present disclosure. In addition, among the constituent elements in the embodiments described below, the constituent element that does not appear in an independent claim, which has the broadest scope, is described as an optional constituent element.

Exemplary Embodiments

Figure 1B:
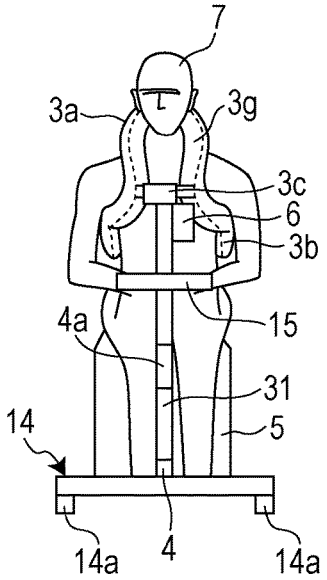
FIG. 1B is a schematic front view of the configuration of the robot according to the exemplary embodiment illustrated together with the care receiver in a sitting posture.
Figure 1C:
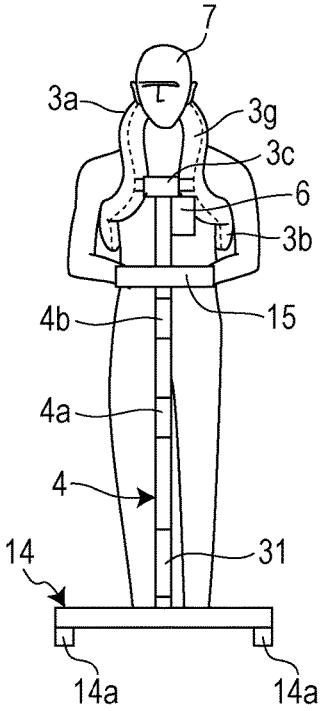
FIG. 1C is a schematic front view of the configuration of the robot according to the exemplary embodiment illustrated together with the care receiver in a standing posture.

FIGS. 1A and 1B illustrate an example of a work using a robot system 1 serving as an example of a standing up or sitting motion support system according to the present exemplary embodiment. More specifically, FIGS. 1A and 1B are a side view and a front view of a robot 20 that supports a care receiver 7 with a motion which starts in a sitting posture and finishes in a standing posture (hereinafter referred to as a "standing-up motion") or the motion which starts in a standing posture and finishes in a sitting posture (hereinafter referred to as a "sitting-down motion") when the care receiver 7 is in a sitting posture, respectively. The care receiver 7 is in a sitting posture by sitting on a seat unit 5 placed on a floor 13. FIG. 1C is a front view of the robot system 1 when the care receiver 7 is in a standing posture. An example of the care receiver 7 is an aged user. In addition, examples of the care receiver 7 include a sick person and a user having difficulty moving in daily activities as a result of injury.

Figure 2:
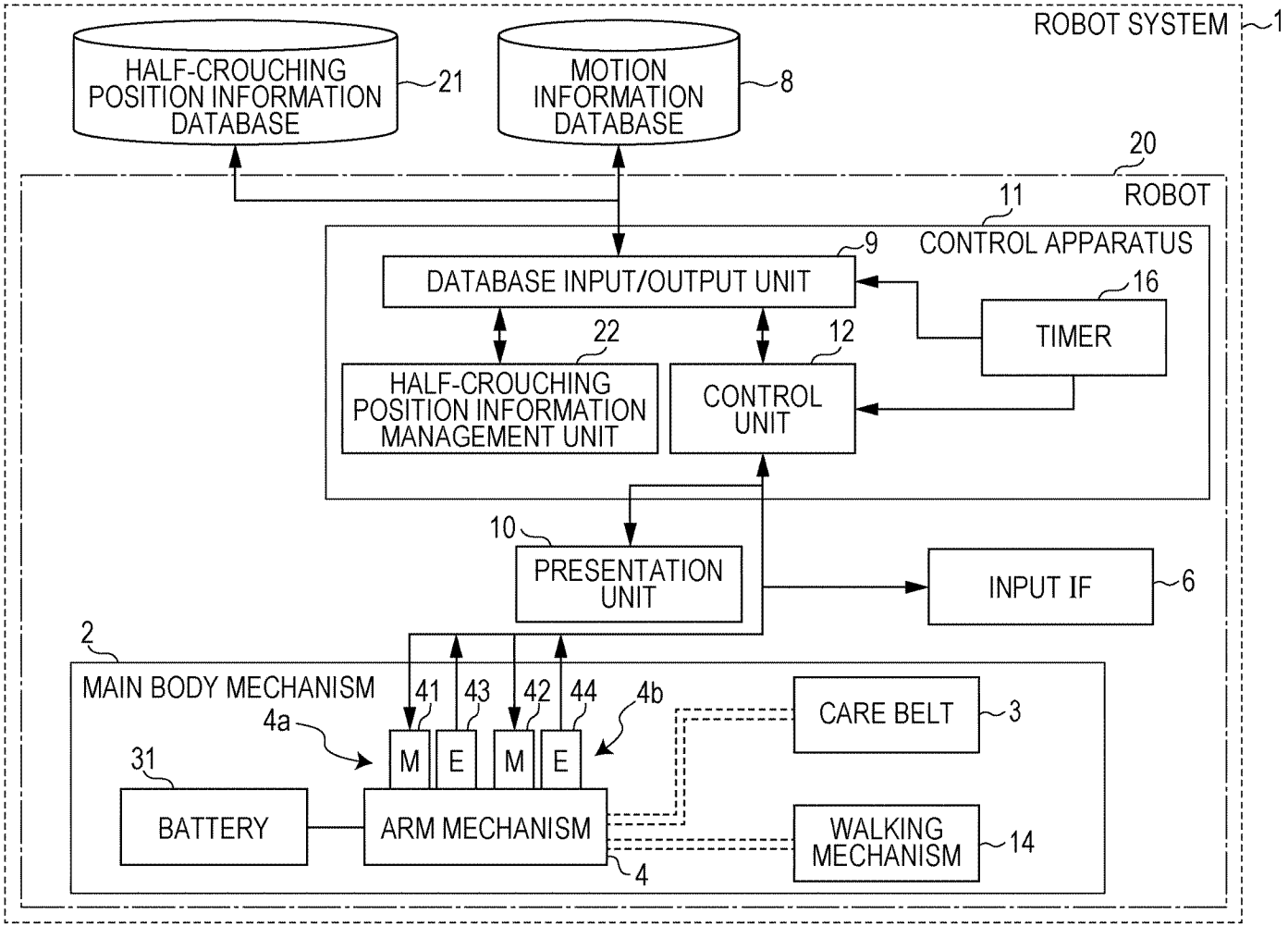
FIG. 2 is a block diagram illustrating a detailed configuration of a robot system according to an exemplary embodiment.
Figure 3A:
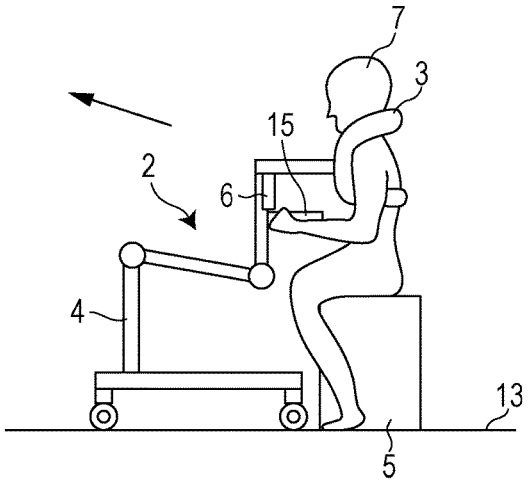
FIG. 3A is a first illustration of an example of a first motion pattern of the standing-up motion of a care receiver using the robot system according to the exemplary embodiment.
Figure 3B:
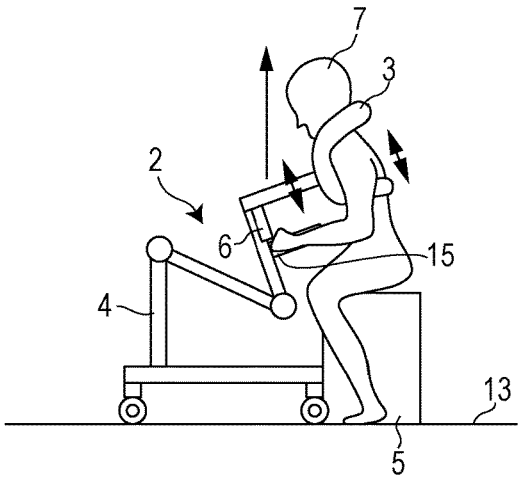
FIG. 3B is a second illustration of an example of the first motion pattern of the standing-up motion of the care receiver using the robot system according to the exemplary embodiment.
Figure 3C:
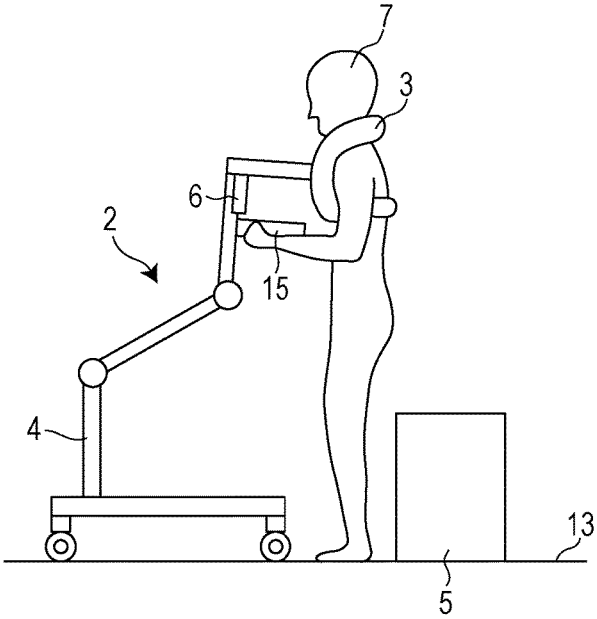
FIG. 3C is a third illustration of an example of the first motion pattern of the standing-up motion of the care receiver using the robot system according to the exemplary embodiment.
Figure 4A:
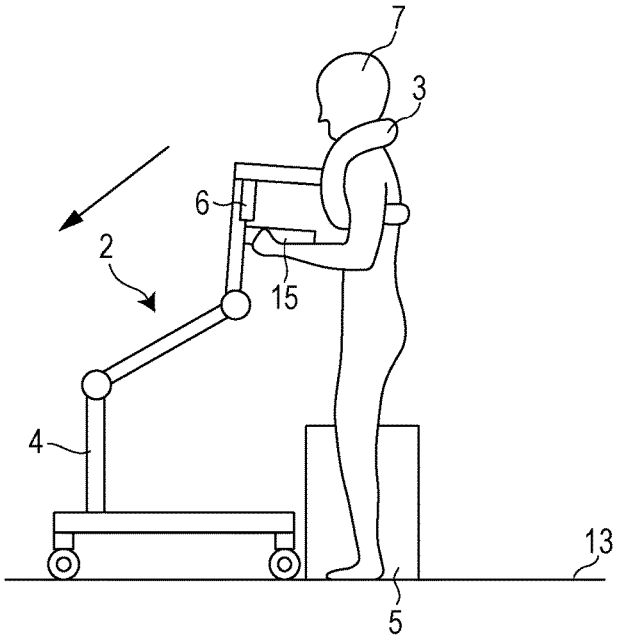
FIG. 4A is a first illustration of an example of a second motion pattern of the standing-up motion of a care receiver using the robot system according to the exemplary embodiment.
Figure 4B:
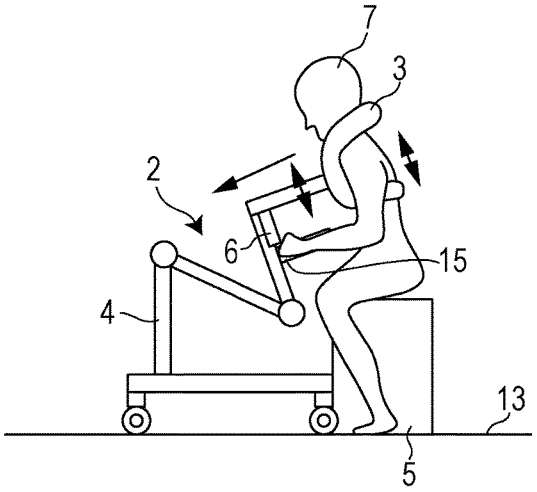
FIG. 4B is a second illustration of an example of the second motion pattern of the standing-up motion of the care receiver using the robot system according to the exemplary embodiment.
Figure 4C:
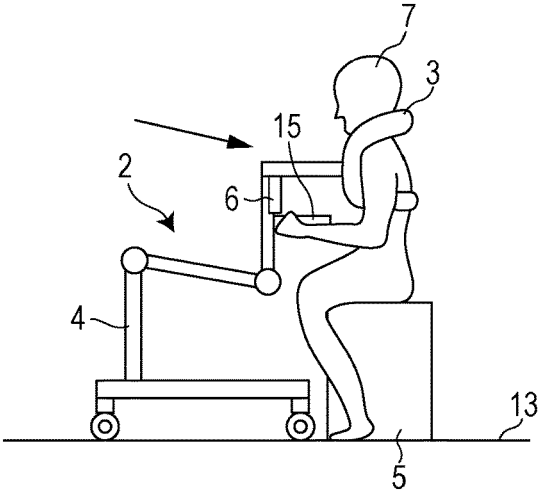
FIG. 4C is a third illustration of an example of the second motion pattern of the standing-up motion of the care receiver using the robot system according to the exemplary embodiment.

FIG. 2 is a block diagram illustrating a detailed configuration of the robot system 1 according to the present exemplary embodiment. FIGS. 3A to 3C illustrate an example of a first motion pattern of the robot 20 in the standing-up motion (an example of a first motion) of the care receiver 7 using the robot system 1 according to the present exemplary embodiment. FIGS. 4A to 4C illustrate an example of a second motion pattern of the robot 20 in the sitting-down motion (an example of a second motion) of the care receiver 7 using the robot system 1 according to the present exemplary embodiment.

As illustrated in FIGS. 1A to 1C and FIG. 2, the robot system 1 is an example of a standing up or sitting-down motion support system for supporting the care receiver 7 with the standing-up motion or the sitting-down motion. The robot system 1 includes the robot 20. As illustrated in FIG. 2, the robot system 1 includes a motion information database 8 outside the robot 20. However, the robot system 1 may include the motion information database 8 inside the robot 20. As illustrated in FIG. 2, the robot system 1 includes a half-crouching position information database 21 outside the robot 20. However, the robot system 1 includes a half-crouching position information database 21 inside the robot 20.

The robot 20 is placed on the floor 13. The robot 20 includes a main body mechanism 2, which is an example of a motion mechanism, a control apparatus 11, an input interface (IF) 6, which is an example of an instruction input apparatus, a half-crouching position information management unit 22, and a control unit 12.

The main body mechanism 2 includes an arm mechanism 4, a care belt 3, which is an example of a holding mechanism, a walking mechanism 14, and a battery 31. The arm mechanism 4 includes at least a robot arm, which is an example of a pull mechanism. Note that the main body mechanism 2 may have a configuration without the walking mechanism 14. In addition, the main body mechanism 2 may have a configuration without the battery 31. In such a case, the robot 20 receives electric power from the outside via, for example, a power supply cable to operate.

The control apparatus 11 includes a database input/output unit 9, a timer 16, and the control unit 12.

Care Belt

As illustrated in FIGS. 1A to 1C, the care belt 3 is attachable to the care receiver 7 to hold the care receiver 7. The care belt 3 includes a first holding portion 3*a*, a second holding portion 3*b*, and a connecting portion 3*c*. The care belt 3 is removable from the robot arm via the connecting portion 3*c*.

A holding mechanism 3*g* includes at least the first holding portion 3*a* and the second holding portion 3*b*.

The first holding portion 3*a* can hold at least one of the neck and the back of the care receiver 7.

The second holding portion 3*b* can hold the waist of the care receiver 7.

The connecting portion 3*c* can be positioned at the chest of the care receiver 7 when the holding mechanism 3*g* is attached to the care receiver 7. In addition, the connecting portion 3*c* connects the first holding portion 3*a* to the second holding portion 3*b* in front of the care receiver 7. The connecting portion 3*c* is connected to the holding mechanism 3*g* and is removably connectable to one end (e.g., the rear end) of the arm mechanism 4 (described in more detail below).

As illustrated in FIGS. 1A to 1C as an example, the connecting portion 3*c* is connected to one end of the arm mechanism 4 in the substantially middle of the chest of the care receiver 7, in the substantially middle of the first holding portion 3*a* and the second holding portion 3*b*, and near the position at which both ends of the first holding portion 3*a* are connected to both ends of the second holding portion 3*b* so as to bridge the two connected ends. The connecting portion 3*c* is connected to one end of the arm mechanism 4 by using, for example, a screw. However, any technique that can connect one end of the arm mechanism 4 to the connecting portion 3*c* may be employed.

Note that the connecting portion 3*c* may be formed from a material that is less expandable than the material of the first holding portion 3*a* and the second holding portion 3*b*. In this manner, when the care belt 3 is pulled by the arm mechanism 4, expansion of the connecting portion 3*c* can be prevented. Accordingly, the external force from the arm mechanism 4 can be reliably transferred to the body of the care receiver 7 via the holding mechanism 3*g*. Thus, the arm mechanism 4 is connected to the connecting portion 3*c* of the care belt 3, and the care belt 3 operates so as to move in accordance with the motion pattern. In this way, the arm mechanism 4 pulls the care belt 3.

Walking Mechanism

The walking mechanism 14 includes a rectangular stand 14*e*, a pair of front wheels 14*a*, a pair of rear wheels 14*b*, a front wheel brake 14*c*, and a rear wheel brake 14*d*. The walking mechanism 14 is placed on the floor 13. Each of the two front wheels 14*a* is rotatably disposed at one of two front end corners of the rectangular stand 14*e*. Each of the two rear wheels 14*b* is rotatably disposed at one of two rear end corners of the rectangular stand 14*e*. The front wheel brake 14*c* applies a braking force to the front wheels 14*a*. The rear wheel brake 14*d* applies a braking force to the rear wheels 14*b*. The walking mechanism 14 includes the arm mechanism 4 in the upper portion thereof. That is, the arm mechanism 4 is supported in an upright position in the middle of the front portion of the rectangular stand 14*e*.

As an example, the front wheels 14*a* and the rear wheels 14*b* are rotated under the condition illustrated in FIG. 3C by the care receiver 7 applying a force to the robot 20 in the front direction (e.g., the left direction in FIG. 3C) and, thus, the robot 20 can serve as a caster walker that supports the care receiver 7 with the walking motion. While the example has been described with reference to the front wheels 14*a* and the rear wheels 14*b* rotated by the care receiver 7 pushing the robot 20, at least one of the pair of front wheels 14*a* and the pair of rear wheels 14*b* may include, for example, a motor so that the pushing force applied to the robot 20 by the care receiver 7 is increased. In this way, the care receiver 7 can easily move.

In addition, as an example, the front wheel brake 14*c* and the rear wheel brake 14*d* may be configured so as to be manually turned on and off (not illustrated in FIGS. 3A to 3C). Alternatively, the front wheel brake 14*c* and the rear wheel brake 14*d* may be configured so as to be turned on and off using an electric signal (e.g., an electromagnetic brake). By turning on the front wheel brake 14*c* or the rear wheel brake 14*d*, a braking force is applied to the front wheels 14*a* or the rear wheels 14*b*. Thereafter, by turning off the front wheel brake 14*c* or the rear wheel brake 14*d*, the braking force is released from the front wheels 14*a* or the rear wheels 14*b*. While the example has been described with reference to the configuration including the pair of front wheels 14*a* and the pair of rear wheels 14*b*, an additional wheel may be provided at the center of the rectangular stand 14*e*. Note that the number of the wheels and the size of each of the wheels are not limited to those illustrated in the drawing.

Arm Mechanism

The arm mechanism 4 is provided on the upper surface of the walking mechanism 14. The top end of the arm mechanism 4 is connected to the holding mechanism 3*g* via the connecting portion 3*c*. The movement of the arm mechanism 4 is controlled by the control unit 12 so as to operate in accordance with the standing-up or sitting-down motion of the care receiver 7 or the motion pattern for supporting with the standing up and sitting-down motion. That is, the arm mechanism 4 operates in accordance with the motion pattern, so that the position of the holding mechanism 3*g* connected to the arm mechanism 4 varies.

For example, the arm mechanism 4 is formed as a robot arm having two degrees of freedom. The arm mechanism 4 includes a first motor 41, a first encoder 43 that detects the rotational speed (e.g., the angle of rotation) of the rotation shaft of the first motor 41, a second motor 42, and a second encoder 44 that detects the rotational speed (e.g., the angle of rotation) of the rotation shaft of the second motor 42. The information regarding the angles of rotation received from the first encoder 43 and the second encoder 44 is converted into the positional information regarding the arm mechanism 4. The control apparatus 11 controls the first motor 41 and the second motor 42 on the basis of the positional information so that the arm mechanism 4 operates in accordance with the motion pattern for supporting the care receiver 7 with the standing-up motion or the sitting-down motion.

Under such control, the arm mechanism 4 causes the robot system 1 to operate as illustrated in FIGS. 3A to 3C as an example of the motion pattern and supports the care receiver 7 with the standing-up motion in which the hip of the care receiver 7 in the sitting posture rises from the seat unit 5. To support with the standing-up motion, the arm mechanism 4 simultaneously pulls the first holding portion 3*a* and the second holding portion 3*b* of the holding mechanism 3*g* diagonally upward in front of the care receiver 7 and, thereafter, pulls the first holding portion 3*a* and the second holding portion 3*b* straight upward. The motion pattern for supporting the standing-up motion for use in the arm mechanism 4 corresponds to a first motion pattern.

As another example of the motion pattern, as illustrated in FIGS. 4A to 4C, the arm mechanism 4 causes the robot system 1 to operate and support the care receiver 7 with the sitting-down motion in which the care receiver 7 in the standing posture is sitting down on the seat unit 5. To support with the sitting-down motion, the arm mechanism 4 simultaneously pulls the first holding portion 3*a* and the second holding portion 3*b* of the holding mechanism 3*g* at least downward and, thereafter, pulls the first holding portion 3*a* and the second holding portion 3*b* downward and slightly forward. Subsequently, the arm mechanism 4 pulls the first holding portion 3*a* and the second holding portion 3*b* downward and slightly rearward. The motion pattern for supporting with the sitting-down motion for use in the arm mechanism 4 corresponds to a second motion pattern.

More specifically, the arm mechanism 4 is configured as a robot arm including a first arm 4*c*, a second arm 4*d*, a third arm 4*e*, a fourth arm 4*f*, a first drive unit 4*a*, and a second drive unit 4*b*. The lower end of the first arm 4*c* is secured to the rectangular stand 14*e* in the middle of the front portion of the rectangular stand 14*e*. The front end of the second arm 4*d* is rotatably connected to the upper end of the first arm 4*c* via a first joint unit including the first drive unit 4*a*. The rear end of the second arm 4*d* is rotatably connected to the lower end of the third arm 4*e* via a second joint unit including the second drive unit 4*b*. The upper end of the third arm 4*e* is secured to the front end of the fourth arm 4*f* so that the axis directions of the third arm 4*e* and the fourth arm 4*f* are perpendicular to each other and, thus, the third arm 4*e* and the fourth arm 4*f* form an L shape. The rear end portion of the fourth arm 4*f* includes a connecting portion 4*g* removably connected to the connecting portion 3*c* of the care belt 3.

The first drive unit 4*a* is disposed in the first joint unit between the first arm 4*c* and the second arm 4*d*. The first drive unit 4*a* includes, for example, the first motor 41 that rotates the second arm 4*d* relative to the first arm 4*c* and the first encoder 43 that detects the information regarding the angle of rotation of the first motor 41. Accordingly, the control unit 12 (described below) can perform control so that the second arm 4*d* is driven to rotate at a predetermined angle relative to the first arm 4*c*. The second drive unit 4*b* is disposed in the second joint unit between the second arm 4*d* and the third arm 4*e*. The second drive unit 4*b* includes, for example, the second motor 42 that rotates the third arm 4*e* relative to the second arm 4*d* and the second encoder 44 that detects the information regarding the angle of rotation of the second motor 42. The information regarding the angles of rotation received from the first encoder 43 and the second encoder 44 is converted into the positional information regarding the arm mechanism 4 and is used as positional information by the control unit 12. In this manner, the third arm 4*e* can be driven so as to move to a desired position by rotating the third arm 4*e* at a predetermined angle relative to the second arm 4*d* under the control of the control unit 12 (described in more detail below).

A handle 15 is provided so as to protrude from the middle portion of the third arm 4*e* rearward (e.g., toward the care receiver 7). The care receiver 7 can hold the handle 15 in both hands when the care receiver 7 is in a sitting posture or stands up. Note that the handle 15 may have a length so that the care receiver 7 can place their arm on it. In this manner, the handle 15 functions as a handle when the care receiver 7 stands up and functions as an armrest on which the arm of the care receiver 7 is placed when the care receiver 7 is walking. Thus, the care receiver 7 can walk more stably. In addition, the fourth arm 4*f* may have a cushioning material, such as urethane. In this manner, even when the care receiver 7 falls forward and, therefore, the face or the upper body of the care receiver 7 collides with the fourth arm 4*f*, the impact can be reduced.

Input IF

The input interface (input IF) 6 (e.g., an operation panel having, for example, buttons thereon) is, for example, removably provided so as to protrude downward from the front portion of the fourth arm 4*f*. By disposing the input IF 6 in this manner, the care receiver 7 in the sitting posture can operate the input IF 6 from the side of the arm mechanism 4. Note that the input IF 6 is operated by a user including the care receiver 7 or a caregiver.

The input IF 6 can receive a standing-up instruction (e.g., a first instruction) input to operate the arm mechanism 4 in accordance with the motion pattern for the standing-up motion of the care receiver 7 or a sitting-down instruction (e.g., a second instruction input) input to operate the arm mechanism 4 in accordance with the motion pattern for the sitting-down motion of the care receiver 7.

Figure 8:
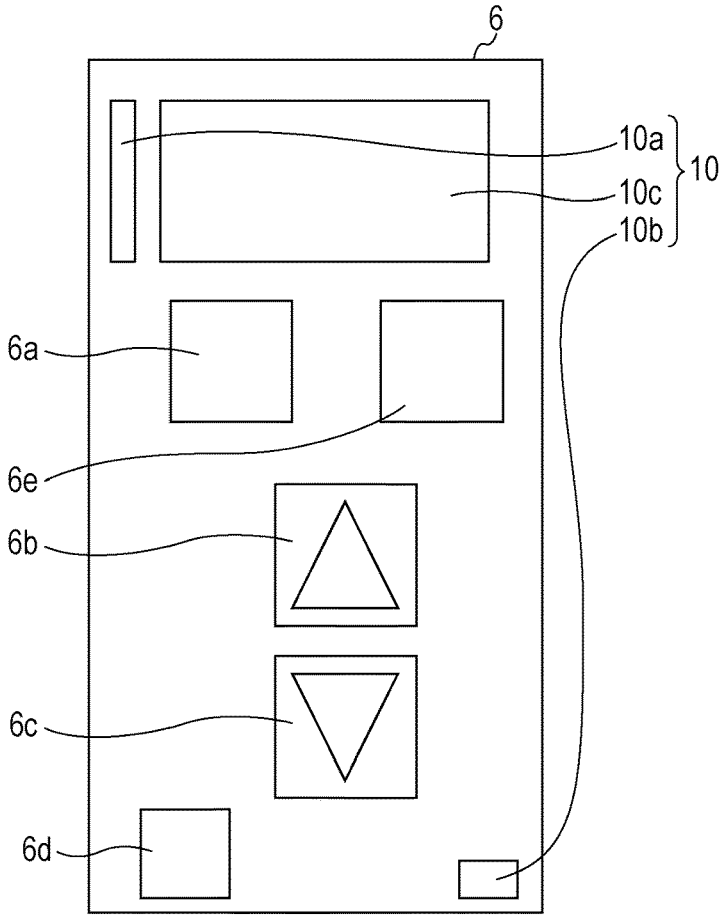
FIG. 8 is a schematic illustration of an input IF and a presentation unit according to the exemplary embodiment.

An example of the input IF 6 is illustrated in FIG. 8. The input IF 6 includes a power button 6*a*, an "Up" button 6*b*, a "Down" button 6*c*, a brake button 6*d*, and a return-to-initial-position button 6*e*. Each of the buttons of the input IF 6 can be operated by the care receiver 7 or the caregiver. Note that the input IF 6 may or may not have a presentation unit 10 illustrated in FIG. 8.

The power button 6*a* is a button for power on or off the robot system 1. For example, if the power button 6*a* is pressed, the power is turned on. In contrast, if the power button 6*a* is pulled back, the power is turned off.

The "Up" button 6*b* is used to operate the arm mechanism 4 to support the care receiver 7 with the standing-up motion. If the "Up" button 6*b* is operated, the arm mechanism 4 operates in accordance with the motion pattern for supporting the care receiver 7 with the standing-up motion.

The "Down" button 6*c* is used to operate the arm mechanism 4 to support the care receiver 7 with the sitting-down motion. If the "Down" button 6*c* is operated, the arm mechanism 4 operates in accordance with the motion pattern for supporting the care receiver 7 with the sitting-down motion.

The brake button 6*d* is used to turn on and off the brakes of the front wheels 14*a* and the rear wheels 14*b*.

The return-to-initial-position button 6*e* is used to move the arm mechanism 4 to the initial position.

An example of the initial position of the arm mechanism 4 is a position close to the front of the body of the care receiver 7, as illustrated in FIG. 3A. In addition, for example, the input IF 6 may be removable from the front portion of the fourth arm 4*f* and function as a remote controller. That is, the caregiver can hold the input IF 6 with their hands and operate the input IF 6. In this description, the initial position is an example of a connection point at which the arm mechanism 4 can be connected to the connecting portion 3*c* of the care belt 3. If the return-to-initial-position button 6*e* is operated, the arm mechanism 4 moves to the initial position, which is an example of the connection point, under the control of the control unit 12. Thereafter, the input IF 6 is enabled to receive an instruction input thereto.

Timer

The timer 16 outputs, to the database input/output unit 9 and the control unit 12, an instruction instructing the database input/output unit 9 and the control unit 12 to perform the processes at predetermined intervals (e.g., 1-ms intervals).

Database Input/Output Unit

The database input/output unit 9 inputs and outputs data (e.g., information) between the motion information database 8 and the control unit 12.

Motion Information Database

The processes are performed by the database input/output unit 9 and the control unit 12 in response to an instruction from the timer 16 and, thus, the positional information regarding the arm mechanism 4 (e.g., the positional information obtained by converting the information regarding the angles of rotation received from the first encoder 43 and the second encoder 44 into the positional information regarding the arm mechanism 4) is generated at predetermined intervals (e.g., 1-ms intervals). The generated positional information serves as the motion information and is output to the motion information database 8 via the database input/output unit 9 together with information regarding the point in time. Thus, the generated positional information is stored in the motion information database 8.

FIG. 5 illustrates an example of the information in the motion information database 8. The motion information database 8 can store a plurality of pieces of motion information, such as standing-up motion information and/or sitting-down motion information. In addition, different motions can be stored as motion information in accordance of the height or the weight of a care receiver 7. At that time, the motions are stored so as to be identified using motion IDs (described below).

(1) The "motion ID" field includes an ID for identifying the type of motion, such as a standing-up motion or a sitting-down motion. For example, the motion ID of the standing-up motion may be represented as "1", and the motion ID of the sitting-down motion may be represented as "2". In such a case, as illustrated in FIG. 5, the series of pieces of information regarding the motion pattern of the standing-up motion in the motion information database 8 have a motion ID of "1".

(2) The "time" field includes information regarding the point in time at which the arm mechanism 4 operates. The unit of time is milliseconds (msec).

(3) The "position" field includes the positional information regarding the arm mechanism 4 obtained by converting the angle information detected by, for example, the first encoder 43 and the second encoder 44 of the arm mechanism 4. More specifically, as illustrated in FIG. 1A, one end of the arm mechanism 4 is defined as a point of origin O, the direction opposite to the travel direction of the robot system 1 is defined as a positive direction along an X-axis, and the upward direction is defined as a positive direction along a Z-axis. Then, the positional information is defined as a position using the two axes, that is, the coordinates relative to the point of origin O. The unit of position is meters (m). The motion information regarding the standing-up motion used to support a care receiver with the standing-up motion may include a standing-up motion support start time corresponding to the point in time at which support of the standing-up motion starts and information regarding the position (e.g., the coordinates) at which a particular portion of the arm mechanism 4 (e.g., the connecting portion 4*g*) is to be positioned at the standing-up motion support start time. In addition, the motion information regarding the standing-up motion may include a standing-up motion support end time corresponding to the point in time at which support of the standing-up motion ends and information regarding the position (e.g., the coordinates) at which a particular portion of the arm mechanism 4 (e.g., the connecting portion 4*g*) is to be positioned at the standing-up motion support end time. The motion information regarding the sitting-down motion used to support the sitting-down motion of a care receiver may include a sitting-down motion support start time corresponding to the point in time at which support of the sitting-down motion starts and information regarding the position (e.g., the coordinates) at which a particular portion of the arm mechanism 4 (e.g., the connecting portion 4*g*) is to be positioned at the sitting-down motion support start time. In addition, the motion information regarding the sitting-down motion may include a sitting-down motion support end time corresponding to the point in time at which support of the sitting-down motion ends and information regarding the position (e.g., the coordinates) at which a particular portion of the arm mechanism 4 (e.g., the connecting portion 4*g*) is to be positioned at the sitting-down motion support end time.

Note that in this example, the standing-up motion and the sitting-down motion are stored as different pieces of motion information identified by different IDs. However, only one piece of the motion information that represents the standing-up motion if the motion information is played back in the forward direction and represents the sitting-down motion if the motion information is played back in the reverse direction (so-called reverse playback) may be stored.

Half-Crouching Position Information Database

FIG. 6 illustrates an example of information in the half-crouching position information database 21.

(1) The "motion ID" field includes one of the motion IDs used for the motion information database 8. For example, the motion ID of the standing-up motion may be represented as "mID1", and the motion ID of the sitting-down motion may be represented as "mID2".

(2) The "half-crouching position time" field includes a half-crouching position time representing a time at which the care receiver 7 is in a half-crouching posture during the motion identified by the above-described motion ID. That is, at the position of the arm mechanism 4 at a time indicated by the half-crouching position time, the arm mechanism 4 causes the care receiver 7 to be in the half-crouching posture. The position of the arm mechanism 4 when the care receiver 7 is in the half-crouching posture corresponds to a "predetermined position", and the half-crouching position time corresponds to first information or second information.

Note that the half-crouching position time is any point in time between a start time t0 and an end time to of the motion information indicated by the motion ID. That is, the half-crouching position time is an elapsed time from the time when support of the standing-up motion or the sitting-down motion starts. The unit of half-crouching position time is milliseconds (msec). Since the main body mechanism 2 operates on the basis of the motion information database 8, identifying the predetermined time corresponds to identifying the position of the main body mechanism 2. That is, the information regarding the half-crouching position time corresponds to the height of a predetermined portion of the main body mechanism 2 when the care receiver 7 is in the half-crouching posture. For example, the predetermined portion of the main body mechanism 2 is the top end of the arm mechanism 4. That is, the half-crouching position information stored in the half-crouching position information database 21 includes information regarding the height of the predetermined portion of the main body mechanism 2 when the care receiver 7 is in the half-crouching posture. The half-crouching position information database 21 corresponds to a storager.

Half-Crouching Position Information Management Unit

The half-crouching position information management unit 22 manages the half-crouching position information database 21 by modifying the half-crouching position information in the half-crouching position information database 21 as needed.

The robot system 1 stores, in the half-crouching position information database 21 (refer to FIG. 6), the time of a half-crouching position for each of the motion IDs appearing in the motion information illustrated in FIG. 5 as a default half-crouching position first. Note that in this example, the half-crouching position is a position at a predetermined height in the range from the height of the waist of the care receiver 7 who is in a sitting posture to the height of the waist of the care receiver 7 who is in a standing posture.

Subsequently, a caregiver 18 or the care receiver 7 halts the arm mechanism 4 by using the input IF 6 during the standing-up motion or the sitting-down motion and instructs the robot to set the half-crouching position to the position at which the arm mechanism 4 halts. In this manner, the half-crouching position information management unit 22 stores, in the half-crouching position time field of the half-crouching position information database 21, a time in the motion information database 8 corresponding to the time at which the arm mechanism 4 halts, together with the motion ID of the motion information. By storing the half-crouching position time in the half-crouching position information database 21 together with the motion ID, the half-crouching position information can be separately managed for each of the sitting-down motion and the standing-up motion. For example, the half-crouching position for the care receiver 7 during the standing-up motion from a toilet is higher than that during the sitting-down motion to the toilet by a predetermined value. As a result, cleaning oneself and handling clothing after using the toilet can be eased. That is, the half-crouching position during support with the motion is not fixed, and the half-crouching positions of the robot appropriate for the care receiver 7 removing clothing from and putting clothing on the lower body while the sitting-down motion and the standing-up motion are being supported in a bathroom are determined. More specifically, the present inventors found that in a bathroom with a toilet, the half-crouching position when the care receiver 7 is putting on clothes is higher than the half-crouching position when the care receiver 7 is removing clothes and, thus, the half-crouching positions appropriate for support with the standing-up motion and the sitting-down motion in the bathroom are determined.

Note that as illustrated in FIG. 7, the half-crouching position time may be stored in the half-crouching position information database 21 in association with a user. More specifically, the motion ID and the half-crouching position time are stored in the half-crouching position information database 21 for each of user IDs that identify the users. In this manner, the half-crouching position information can be stored in the half-crouching position information database 21 for each of care receivers. Thus, the half-crouching position can be stored in the half-crouching position information database 21 for each of care receivers having different body heights and other conditions. In such a case, before starting operating the robot 20, the control unit 12 receives a user ID (corresponding to identification information) and, thereafter, detects the half-crouching position by using the half-crouching position time associated with the care receiver 7 indicated by the received user ID in the half-crouching position information database 21.

In addition, the user ID may be stored in the half-crouching position information database 21 as an ID for identifying the body height of a user. As an example, by assigning the half-crouching position information for a care receiver having a body height of 175 cm, the half-crouching position information for a care receiver having a body height of 165 cm, and the half-crouching position information for a care receiver having a body height of 155 cm to the user IDs "UD1", "UD2", and "UD3", respectively, the half-crouching position information management unit 22 can manage the half-crouching position for each of the body heights of care receivers. In this manner, the half-crouching position can be appropriately changed each time the half-crouching position information database 21 is used for a different care receiver.

Alternatively, the half-crouching position information management unit 22 may calculate an appropriate half-crouching position from history information regarding the set half-crouching position information and store the calculated half-crouching position in the half-crouching position information database 21. As an example, the half-crouching position information management unit 22 may calculate an appropriate half-crouching position by storing all the set half-crouching position times and obtaining the average value of the stored half-crouching position times or obtaining the average value of a predetermined number of the latest half-crouching position times (e.g., 10 half-crouching position times).

In addition, while the above description has been given with reference to the instruction instructing that the position at which the caregiver 18 or the care receiver 7 halts the arm mechanism 4 is to be set as the half-crouching position, the position at which the arm mechanism 4 is stationary for a predetermined period of time or longer (e.g., 10 seconds or longer) may be identified, and the identified position may be selected as the half-crouching position. In this manner, the half-crouching position can be stored without receiving an explicit instruction from the caregiver 18 or the care receiver 7.

Control Unit

The control unit 12 controls the arm mechanism 4 and other units on the basis of an instruction input through the input IF 6. In addition, the control unit 12 controls braking forces of the front wheel brake 14*c* and the rear wheel brake 14*d* on the basis of the on/off instruction for the front wheel brakes 14*c* and 14*d* input through the input IF 6. Furthermore, the control unit 12 acquires the half-crouching position information from the half-crouching position information database 21 via the database input/output unit 9 and instructs the presentation unit 10 to present the half-crouching position information.

In addition, to stop or reduce the speed of the robot 20 at the half-crouching position, the control unit 12 may perform control so that the robot 20 halts if the half-crouching position time is reached. Furthermore, the control unit 12 may set the speed of the robot 20 during the sitting-down motion to a value lower than the speed during the standing-up motion. For example, the speed during the sitting-down motion is set so as to be lower than that during the standing-up motion by 10%. Thus, the robot 20 can support the motion so as to accommodate the standing-up and sitting-down motion of a human.

By performing the above-described operation, the control unit 12 acquires first information for identifying a predetermined position of the arm mechanism 4 during a motion in accordance with the first motion pattern and detects whether the current position of the arm mechanism 4 operating in accordance with the first motion pattern is included in a first range including the predetermined position identified by the first information. If the control unit 12 detects that the position of the arm mechanism 4 is included in the first range, the control unit 12 may decrease the speed of the operation performed by the arm mechanism 4.

In addition, the control unit 12 may acquire second information for identifying a predetermined position of the arm mechanism 4 during a motion in accordance with the second motion pattern and detect whether the current position of the arm mechanism 4 operating in accordance with the second motion pattern is included in a second range including the predetermined position identified by the second information. If the control unit 12 detects that the position of the arm mechanism 4 is included in the second range, the control unit 12 may decrease the speed of the operation performed by the arm mechanism 4. In addition, the first range may be larger than the second range. For example, if the speed of the arm mechanism 4 during the sitting-down motion is set so as to be lower than the speed during the standing-up motion, the first range may be larger than the second range in accordance with the speed.

Presentation Unit

When the position of the arm mechanism 4 is the half-crouching position, the presentation unit 10 presents information indicating that the position of the arm mechanism 4 is the half-crouching position on the basis of the half-crouching position information determined by the half-crouching position information management unit 22. Among the information, information regarding standing-up motion support provided by the robot 20 corresponds to a first signal, and information regarding sitting-down motion support provided by the robot 20 corresponds to a second signal.

Figure 9:
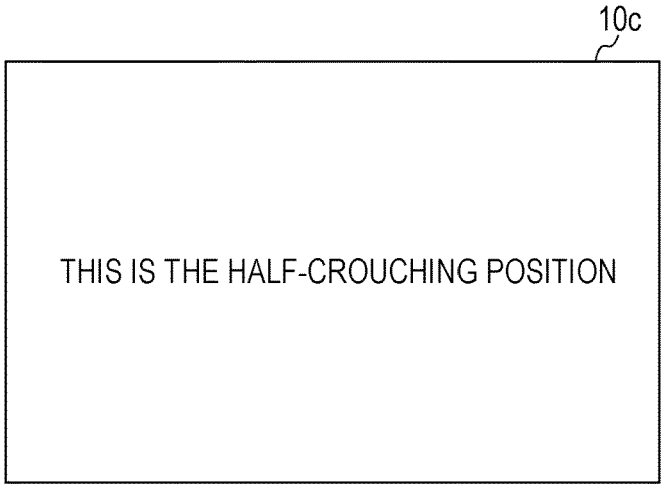
FIG. 9 illustrates an example of the information presented by the presentation unit according to the exemplary embodiment.

The presentation unit 10 includes, for example, a loudspeaker 10*a*, a vibration device 10*b*, and a liquid crystal monitor 10*c* mounted in the upper portion of the input IF 6, such as a remote controller illustrated in FIG. 8. If the arm mechanism 4 moves closer to the half-crouching position, the presentation unit 10 displays, on the liquid crystal monitor 10*c*, an image indicating that the position is the half-crouching position, as illustrated in FIG. 9, or outputs the voice "This is the half-crouching position" from the loudspeaker 10*a*. In this manner, the presentation unit 10 gives a presentation. Alternatively, if the arm mechanism 4 moves closer to the half-crouching position, the presentation unit 10 may give a presentation by vibrating the input IF 6 by using the vibration device 10*b*. In addition, when the presentation unit 10 gives a presentation using the loudspeaker 10*a*, the presentation unit 10 may gradually increase the sound slightly before the half-crouching position is reached (e.g., "pip" first, thereafter "pip pip", and then "pip pip pip") or may gradually increase the vibration generated by the vibration device 10*b*. The determination as to whether the arm mechanism 4 moves closer to the half-crouching position is made by determining whether the current position of the arm mechanism 4 is included in the range around the half-crouching position (corresponding to the first range). For example, the range is defined as a distance which the arm mechanism 4 moves in 5 seconds.

In addition, the control unit 12 may reduce the speed of the standing-up motion support operation or the sitting-down motion support operation or automatically stop the operation at the half-crouching position if the arm mechanism 4 approaches the half-crouching position. In such a case, the control unit 12 can resume the standing-up motion or the sitting-down motion by receiving the operation performed on the "Up" button 6*b* or the "Down" button 6*c* again.

Operation

The operation performed by the robot system 1 under the control of the control unit 12 is described below. The operation sequence of the arm mechanism 4 of the robot system 1 and the motions of the caregiver 18 and the care receiver 7 in accordance with the operation of the arm mechanism 4 are illustrated in FIGS. 3A to 3C, FIGS. 4A to 4C, and FIGS. 10A to 10C. The operation performed by the robot system 1 is illustrated in FIGS. 11 to 15.

Figure 11:
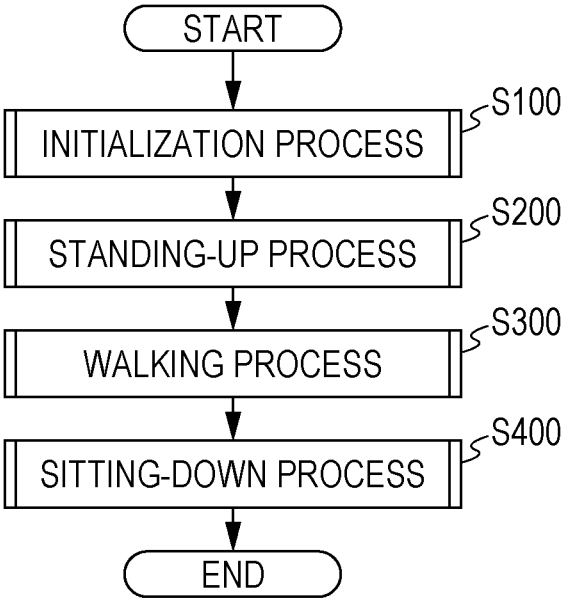
FIG. 11 is a flow diagram illustrating a series of processes performed by the robot system according to the exemplary embodiment.

FIG. 11 illustrates an operation flow of a standing up process, a walking process, and a sitting down process performed by the robot system 1 from the time the care receiver 7 sits on a bed to the time the care receiver 7 sits on a toilet.

The robot system 1 performs an initialization process, such as a power-on process, first (step S100). Thereafter, the robot system 1 performs the standing up process to support the care receiver 7 with the standing-up motion from the bed (step S200) and the walking process to support the care receiver 7 with the walking motion from the bed to a toilet (step S300). Finally, the robot system 1 performs the sitting down process to support the care receiver 7 with the sitting-down motion onto a toilet seat (step S400). Each of the steps is described in detail below.

Initialization Process

Figure 12:
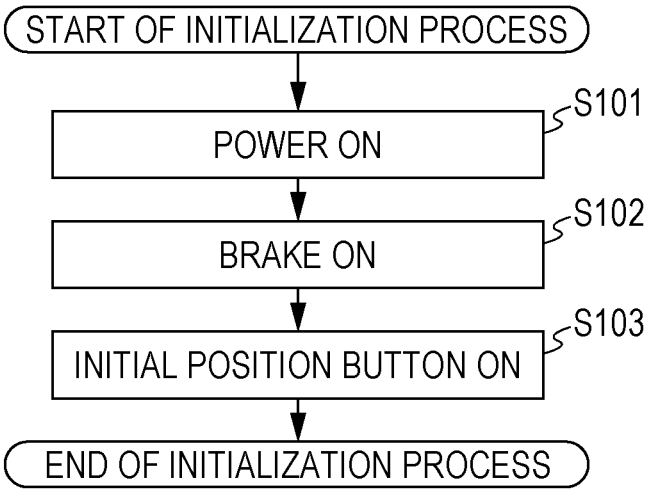
FIG. 12 is a flow diagram illustrating an initialization process performed by the robot system according to the present exemplary embodiment.

FIG. 12 is a flow diagram illustrating the initialization process performed by the robot system 1 according to the present exemplary embodiment. The flow diagram illustrated in FIG. 12 describes the initialization process illustrated in FIG. 11 (step S100) in detail.

Figure 10A:
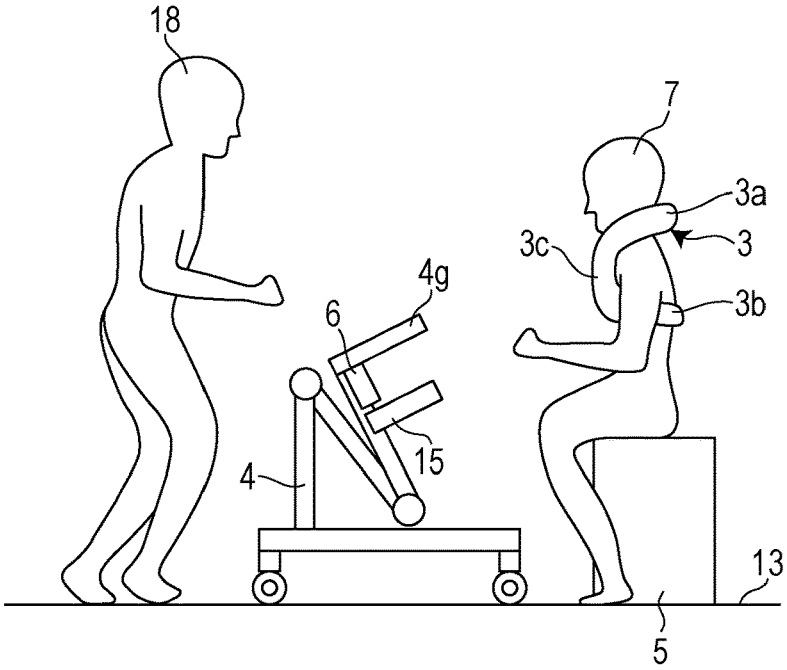
FIG. 10A is a first illustration of the operation performed by the robot system according to the exemplary embodiment from the time an arm mechanism stays in the folded position to the time the arm mechanism is attached to a care receiver.

As illustrated in FIG. 10A, the care receiver 7 sits on the seat unit 5, such as a bed, placed on the floor 13 first. The caregiver 18 moves the robot system 1 with the arm mechanism 4 folded for storage in front of the care receiver 7.

In step S101, the caregiver 18 or the care receiver 7 powers on the robot system 1 by using the power button 6*a* of the input IF 6 of the robot 20.

In step S102, the caregiver 18 or the care receiver 7 turns on the brake by using the brake button 6*d* of the input IF 6 of the robot 20.

Figure 10B:
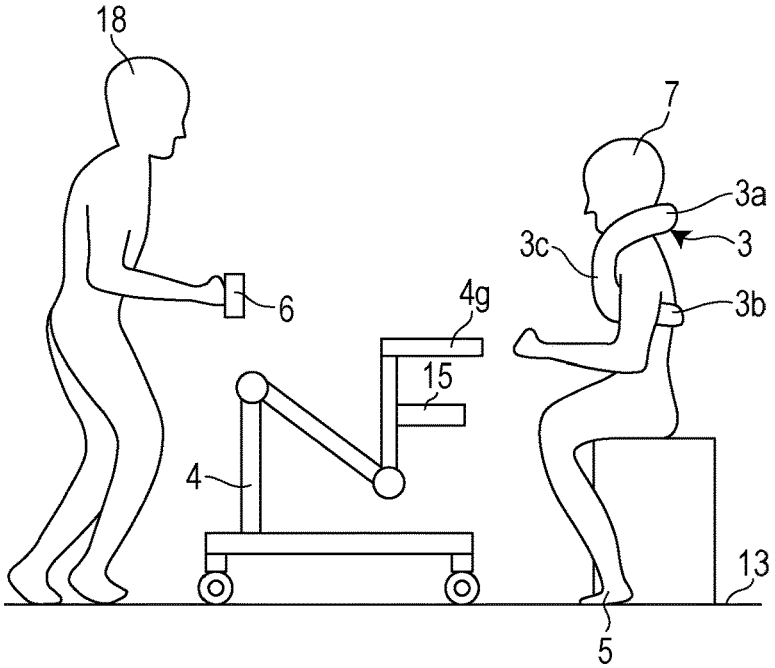
FIG. 10B is a second illustration of the operation performed by the robot system according to the exemplary embodiment from the time the arm mechanism stays in the folded position to the time the arm mechanism is attached to a care receiver.
Figure 10C:
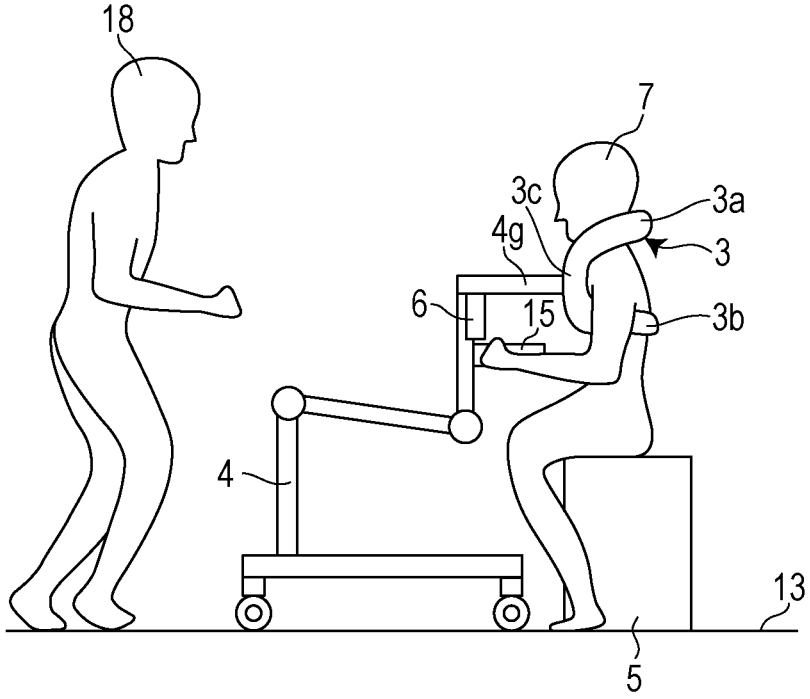
FIG. 10C is a third illustration of the operation performed by the robot system according to the exemplary embodiment from the time the arm mechanism stays in a folded position to the time the arm mechanism is attached to a care receiver.

In step S103, upon receiving the operation performed on the return-to-initial-position button 6*e* of the input IF 6 of the robot 20 by the caregiver 18 or the care receiver 7, the control unit 12 moves the robot system 1 to the initial position, as illustrated in FIG. 10B. Thereafter, as illustrated in FIG. 10C, the care receiver 7 is connected to the robot 20. In this manner, the control unit 12 completes the initialization process.

Standing Up Process

Figure 13:
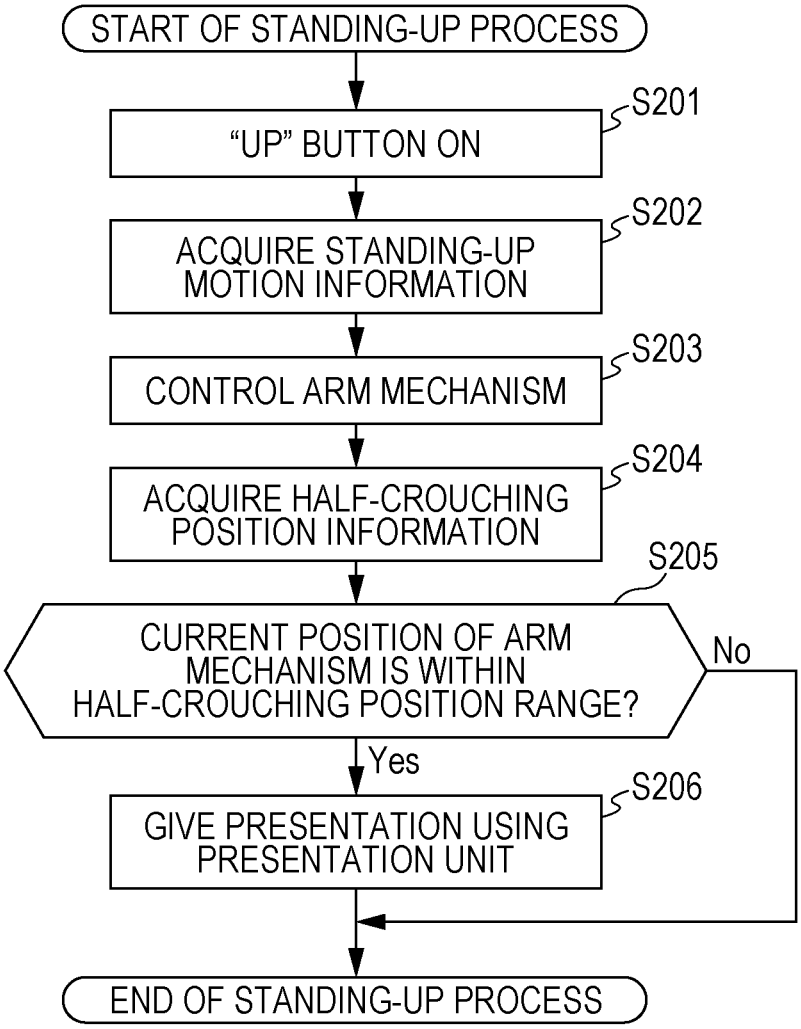
FIG. 13 is a flow diagram illustrating a standing up process performed by the robot system according to the exemplary embodiment.

FIG. 13 is a flow diagram illustrating the standing up process performed by the robot system 1 according to the present exemplary embodiment. The flow diagram illustrated in FIG. 13 describes the standing up process illustrated in FIG. 11 (step S200) in detail.

In step S201, upon receiving the pressing operation performed on the "Up" button 6*b* of the input IF 6 by the caregiver 18 or the care receiver 7, the robot system 1 starts supporting the care receiver 7 with the standing-up motion. In this example, if the "Up" button 6*b* is pressed and, thereafter, is released, the robot system 1 starts operating to support the care receiver 7 with the standing-up motion so that the care receiver 7 moves from a sitting posture to a standing posture.

In step S202, the control unit 12 acquires the motion information in the motion information database 8 (e.g., the motion information having a motion ID of the standing-up motion) via the database input/output unit 9.

In step S203, the control unit 12 controls the arm mechanism 4 so that the arm mechanism 4 is located at the position indicated by the motion information acquired in step S202. More specifically, the control unit 12 causes the arm mechanism 4 to sequentially operate as illustrated in FIG. 3A, FIG. 3B, and FIG. 3C.

In step S204, the control unit 12 acquires the half-crouching position information (more specifically, the half-crouching position time) from the half-crouching position information database 21 via the database input/output unit 9.

In step S205, the control unit 12 determines whether the position of the arm mechanism 4 is the half-crouching position. More specifically, the control unit 12 determines whether a time indicating the current time in the motion information database 8 is the half-crouching position time acquired in step S204. The time indicating the current time may be the latest time recorded in the half-crouching position information database 21. Alternatively, the time indicating the current time may be at least one of the times included in a time range from the latest time recorded in the half-crouching position information database to a predetermined time. At that time, the information regarding the time indicating the current time corresponds to the position of the arm mechanism 4 at the current time.

If, in step S205, the control unit 12 determines that the position of the arm mechanism 4 is the half-crouching position (Yes in step S205), the processing proceeds to step S206. However, if the control unit 12 determines that the position of the arm mechanism 4 is not the half-crouching position (No in step S205), the control unit 12 completes the standing up process.

In step S206, the control unit 12 causes the presentation unit 10 to present that the position of the arm mechanism 4 is the half-crouching position by using an image, voice, or vibration. After the presentation, the control unit 12 controls the arm mechanism 4 so that the arm mechanism 4 is sequentially located at the positions in the motion information acquired in step S202 and, thereafter, completes supporting the care receiver 7 with the standing-up motion (refer to FIGS. 3B and 3C).

Walking Process

Figure 14:
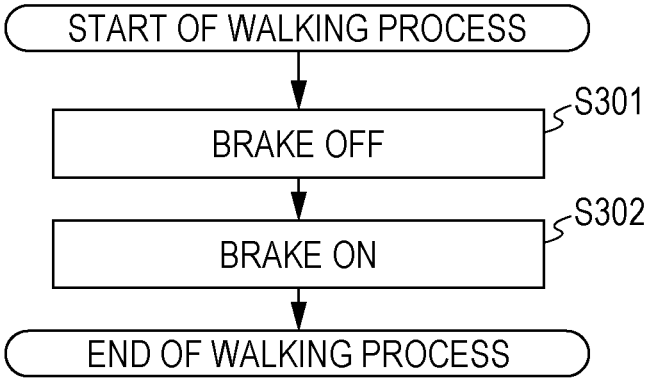
FIG. 14 is a flow diagram illustrating a walking process performed by the robot system according to the exemplary embodiment.

FIG. 14 is a flow diagram illustrating the walking process performed by the robot system 1 according to the present exemplary embodiment. The flow diagram illustrated in FIG. 14 describes the walking process illustrated in FIG. 14 (step S300) in detail.

In step S301, the robot system 1 receives the operation performed on the brake button 6*d* of the input IF 6 to turn off the brake. Thereafter, the care receiver 7 applies a force to the robot 20 in the frontward direction (the left direction in FIG. 3C) so that the wheels of the walking mechanism 14 rotate. Thus, the robot 20 serves as a wheeled walker and provides support to the care receiver 7 while walking. Upon completion of the movement, the processing proceeds to step S302.

In step S302, the robot system 1 receives the operation performed on the brake button 6*d* of the input IF 6 of the robot 20 to turn on the brake. Thus, the robot system 1 completes the walking process.

Sitting Down Process

Figure 15:
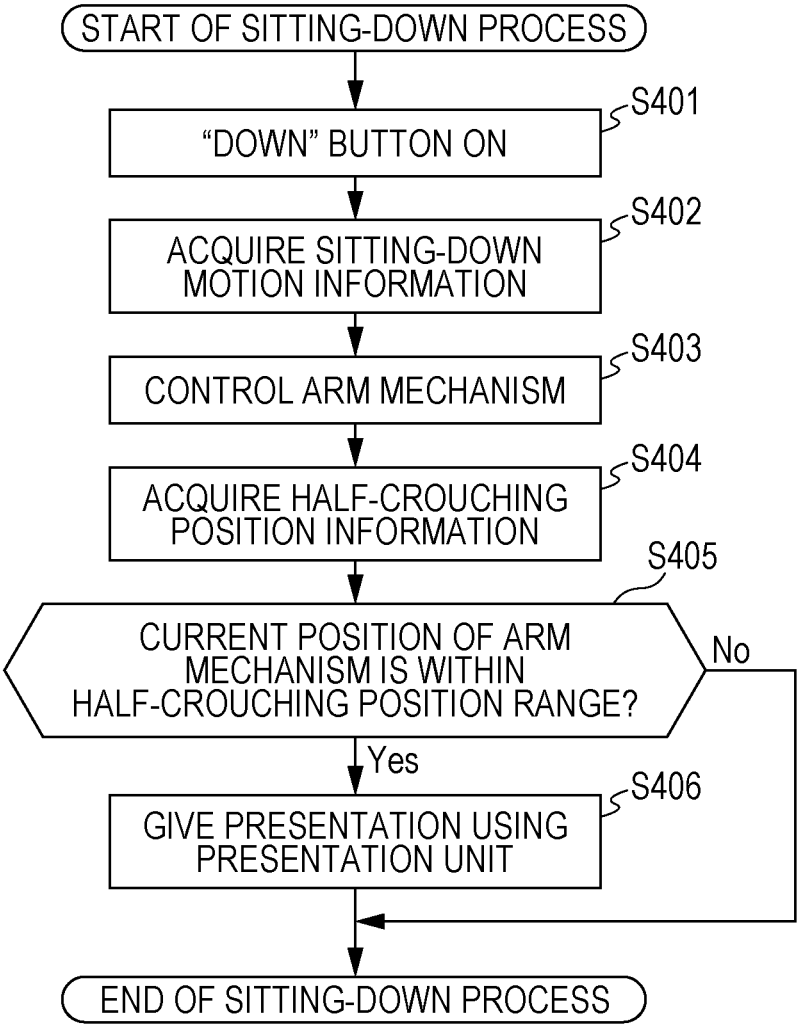
FIG. 15 is a flow diagram illustrating a sitting down process performed by the robot system according to the exemplary embodiment.

FIG. 15 is a flow diagram illustrating the sitting down process performed by the robot system 1 according to the present exemplary embodiment. The flow diagram illustrated in FIG. 15 describes the sitting down process illustrated in FIG. 11 (step S400) in detail.

In step S401, upon receiving the pressing operation performed on the "Down" button 6*c* of the input IF 6 by the caregiver 18 or the care receiver 7, the robot system 1 starts supporting the care receiver 7 with the sitting-down motion. In this example, if the "Down" button 6*c* is pressed and, thereafter, is released, the robot system 1 starts operating to support the care receiver 7 with the sitting-down motion so that the care receiver 7 moves from a standing posture to a sitting posture.

In step S402, the control unit 12 acquires the motion information in the motion information database 8 (e.g., the motion information having a motion ID of the sitting-down motion) via the database input/output unit 9.

In step S403, the control unit 12 controls the arm mechanism 4 so that the arm mechanism 4 is located at the position indicated by the motion information acquired in step S402. More specifically, the control unit 12 causes the arm mechanism 4 to sequentially operate as illustrated in FIG. 4A, FIG. 4B, and FIG. 4C.

In step S404, the control unit 12 acquires the half-crouching position information (more specifically, the half-crouching position time) from the half-crouching position information database 21 via the database input/output unit 9.

In step S405, the control unit 12 determines whether the position of the arm mechanism 4 is the half-crouching position. More specifically, the control unit 12 determines whether a time indicating the current time in the motion information database 8 is the half-crouching position time acquired in step S404. If, in step S405, the control unit 12 determines that the position of the arm mechanism 4 is the half-crouching position (Yes in step S405), the processing proceeds to step S406. However, if the control unit 12 determines that the position of the arm mechanism 4 is not the half-crouching position (No in step S405), the control unit 12 completes the sitting down process.

In step S406, the control unit 12 causes the presentation unit 10 to present that the position of the arm mechanism 4 is the half-crouching position by using an image, voice, or vibration. After the presentation, the control unit 12 controls the arm mechanism 4 so that the arm mechanism 4 is sequentially located at the positions in the motion information acquired in step S402 and, thereafter, completes providing support with the sitting-down motion.

As described above, the robot 20 according to the present exemplary embodiment acquires a predetermined position of the motion mechanism (e.g., the position of the robot that causes the care receiver 7 to be in a half-crouching posture). If the robot 20 detects that the position of the motion mechanism is included in a range including the acquired predetermined position (the first range), the robot 20 presents the first signal to the care receiver. In this manner, the robot 20 can present a half-crouching position appropriate for the care receiver.

Figure 16:
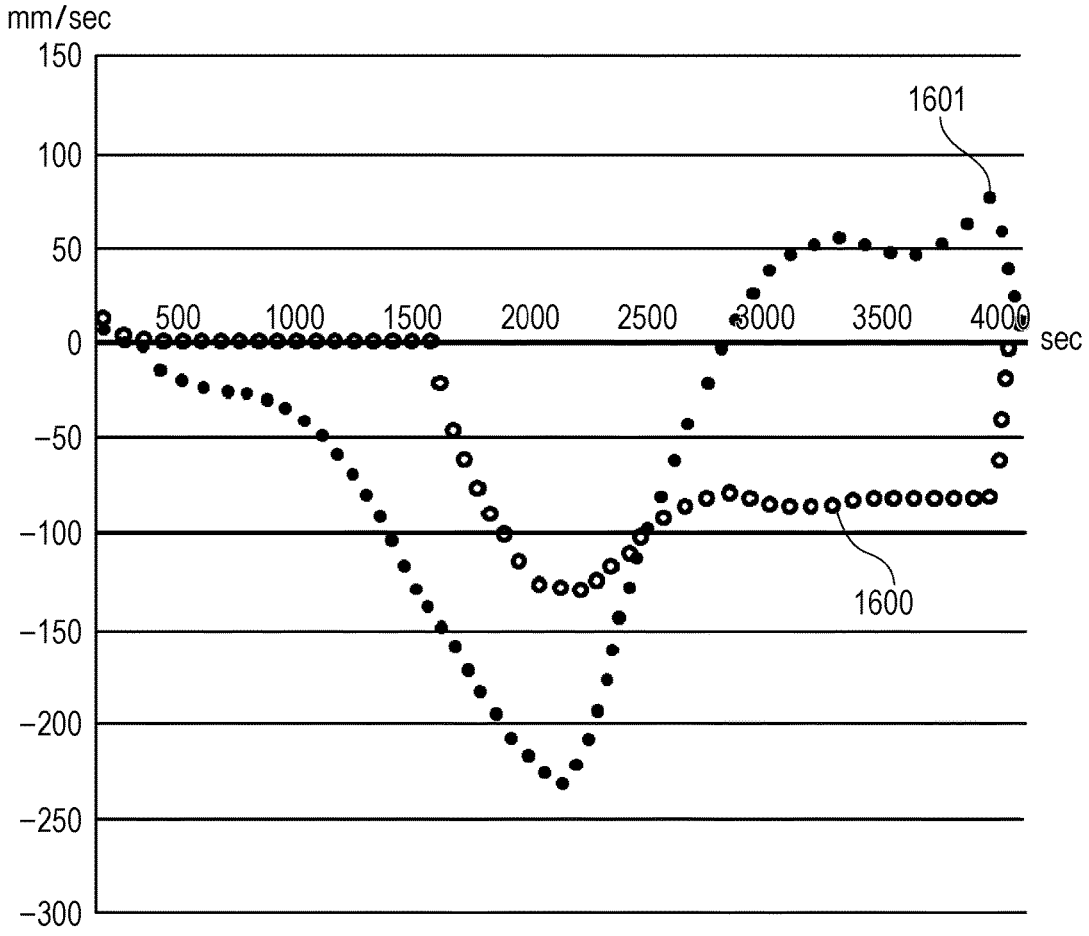
FIG. 16 illustrates an example of the speed of the standing-up motion of a supported user in the half-crouching posture.

FIG. 16 illustrates an example of the speed of the standing-up motion of a supported user while in the half-crouching posture. The ordinate in FIG. 16 represents the speed (mm/sec) of the motion of the user in the half-crouching posture, and the abscissa represents a time (sec). Data 1600 illustrated in FIG. 16 indicates the speed of the motion of the user in the X-axis direction while in the half-crouching posture, and data 1601 indicates the speed of the motion of the user in the Z-axis direction while in the half-crouching posture. A positive sign indicates the downward direction along the Z-axis and the direction opposite to the standing up direction along the X-axis. The speed in the Z-axis direction is in the range from −150 mm/s to −250 mm/s for a period of time from 1000 seconds to 2500 seconds, and the speed in the X-axis direction is in the range from −50 mm/s to −150 mm/s. In the case of the motion support illustrated in FIG. 16, it takes several seconds to several ten seconds for a motion which is from a standing posture to a sitting posture or from the sitting posture to the standing posture. Accordingly, in the standing-up motion support or the sitting-down motion support, it may be difficult for the user to halt the robot 20 at the half-crouching position in the motion. By presenting the first signal to the care receiver if it is detected that the position of the motion mechanism is included in the range including the acquired predetermined position (the first range), the robot 20 can present the position of the robot that causes the care receiver to be in an appropriate half-crouching posture.

Note that in the above-described exemplary embodiments, each of the constituent elements may be configured as dedicated hardware or may be achieved by executing a software program suitable for the constituent element. Each of the constituent elements may be achieved by a program execution unit, such as a central processing unit (CPU) or a processor, reading the software program stored in a recording medium, such as a hard disk or a semiconductor memory, and executing the software program. In this case, the software that provides the robots according to the exemplary embodiments is a program described below.

That is, the program causes a computer to execute a method for controlling a robot including a motion mechanism that operates in accordance with a first motion pattern for supporting a care receiver with the standing-up motion which starts in a sitting posture and finishes in a standing posture. The method includes acquiring first information used to identify a predetermined position of the motion mechanism during a motion in accordance with the first motion pattern, detecting whether the current position of the motion mechanism operating in accordance with the first motion pattern is included in a first range including the predetermined position identified by the first information, and presenting a first signal if it is detected that the position of the motion mechanism is included in the first range.

In addition, the program causes a computer to execute a method for controlling a robot including a motion mechanism that operates in accordance with a first motion pattern for supporting a care receiver with a standing-up motion which starts in a sitting posture and finishes in a standing posture. The method includes acquiring first information used to identify a predetermined position of the motion mechanism during a motion in accordance with the first motion pattern and reducing the speed of the motion performed by the motion mechanism if it is detected that the current position of the motion mechanism operating in accordance with the first motion pattern is included in a first range including the predetermined position identified by the first information.

While the robots according to one or more aspects have been described with reference to exemplary embodiments, the present disclosure is not limited to the exemplary embodiments. A variety of modifications of the embodiments made by those skilled in the art and embodiments carried out by combining the constituent elements in different embodiments may be encompassed within the one or more aspects.

According to the present disclosure, a robot that presents an appropriate half-crouching position to a care receiver and that supports the care receiver with the motion can be provided.

What is claimed is:

1. A robot comprising:

a motion mechanism that operates in accordance with a first motion pattern for supporting a user with a standing-up motion which starts in a sitting posture and finishes in a standing posture;

a controller that (i) acquires first information used to identify a predetermined position of the motion mechanism corresponding to a half-crouching posture of the user during a motion in accordance with the first motion pattern and (ii) detects whether a current position of the motion mechanism operating in accordance with the first motion pattern is included in a first range including the predetermined position identified by the first information; and a presenter that presents a first signal if the controller detects that the current position of the motion mechanism is included in the first range.

2. The robot according to claim 1, wherein the motion mechanism is capable of halting the motion on the basis of manipulation performed on the motion mechanism, wherein the robot further comprises:

a storager that stores position identification information used to identify a position at which the motion mechanism is stationary for a predetermined period of time or longer during the motion in accordance with the first motion pattern, and wherein the controller acquires the position identification information stored in the storager as the first information and performs the detection using the acquired first information.

3. The robot according to claim 2, wherein the storager stores the position identification information in association with each of a plurality of users, and wherein the controller receives user identification information associated with one of the plurality of users before the motion in accordance with the first motion pattern is performed, acquires the position identification information associated with the user indicated by the received user identification information as the first information, and performs the detection by using the acquired first information.

4. The robot according to claim 1, wherein the motion mechanism operates in accordance with a second motion pattern for supporting a user with a sitting-down motion which starts in a standing posture and finishes in a sitting posture, wherein the controller further (i) acquires second information used to identify a predetermined position of the motion mechanism corresponding to the half-crouching posture of the user during a motion in accordance with the second motion pattern and (ii) detects whether the current position of the motion mechanism operating in accordance with the second motion pattern is included in a second range including the predetermined position identified by the second information, and wherein the presenter further presents a second signal if the controller detects that the position of the motion mechanism is included in the second range.

5. The robot according to claim 4, wherein the position identified by the first information differs from the position identified by the second information.

6. A method for controlling a robot, the robot including a motion mechanism that operates in accordance with a first motion pattern for supporting a user with a standing-up motion which starts in a sitting posture and finishes in a standing posture, the method comprising:

acquiring first information used to identify a predetermined position of the motion mechanism corresponding to a half-crouching posture of the user during a motion in accordance with the first motion pattern;

detecting whether a current position of the motion mechanism operating in accordance with the first motion pattern is included in a first range including the predetermined position identified by the first information; and presenting a first signal if it is detected that the current position of the motion mechanism is included in the first range.

7. A non-transitory computer-readable recording medium storing a control program, the control program causing an apparatus including a processor to perform a process, the apparatus being a robot including a motion mechanism that operates in accordance with a first motion pattern for supporting a user with a standing-up motion which starts in a sitting posture and finishes in a standing posture, the process including:

acquiring first information used to identify a predetermined position of the motion mechanism corresponding to a half-crouching posture of the user during a motion in accordance with the first motion pattern;

detecting whether a current position of the motion mechanism operating in accordance with the first motion pattern is included in a first range including the predetermined position identified by the first information; and presenting a first signal if it is detected that the current position of the motion mechanism is included in the first range.

* * * * *